US005884468A

United States Patent [19]

Reuters

[11] Patent Number: 5,884,468

[45] Date of Patent: Mar. 23, 1999

[54] CENTERING DEVICE FOR TUBES

[75] Inventor: Hans-Jakob Reuters, Viersen, Germany

[73] Assignee: W. Schlafhorst AG & Co., Monchen-Gladbach, Germany

[21] Appl. No.: 984,864

[22] Filed: Dec. 4, 1997

[30] Foreign Application Priority Data

Dec. 6, 1996 [DE] Germany ..... 196 50 735.9

[51] Int. Cl.[6] ..... D01H 11/00

[52] U.S. Cl. ..... 57/300; 28/292; 28/295; 28/297; 57/303; 57/304; 57/306

[58] Field of Search ..... 57/300, 303, 304, 57/305, 306; 269/280; 242/128, 596.1; 28/292, 293, 294, 295, 297, 298

[56] References Cited

U.S. PATENT DOCUMENTS

| | | | |
|---|---|---|---|
| 4,628,686 | 12/1986 | Tone et al. | 57/305 |
| 4,827,582 | 5/1989 | Yamashita | 28/293 |
| 4,899,532 | 2/1990 | Sanno | 57/304 |
| 5,103,525 | 4/1992 | Nakayama | 15/88.3 |
| 5,109,662 | 5/1992 | Inger | 57/305 |
| 5,341,549 | 8/1994 | Wirtz et al. | 28/298 |
| 5,452,571 | 9/1995 | Okuyama et al. | 57/281 |

FOREIGN PATENT DOCUMENTS

| | | | |
|---|---|---|---|
| 41 31 667 A1 | 9/1991 | Germany . | |
| 5-70043 | 3/1993 | Japan | 57/300 |

*Primary Examiner*—William Stryjewski
*Attorney, Agent, or Firm*—Kennedy Covington Lobdell & Hickman LLP

[57] ABSTRACT

A device for centering tubes during their processing, for example in a tube cleaning station of a textile machine. In a textile machine provided with several batches of tubes of differing length, diameter and/or material, which cannot be processed together in known cleaning devices, the present device has a rotatably seated holder with at least two differing centering devices adapted for different tubes for selective positionability relative to the tubes to be centered according to sensor devices which detect the differing physical characteristics of the tubes.

14 Claims, 4 Drawing Sheets

CENTERING DEVICE FOR TUBES

FIELD OF THE INVENTION

The present invention relates to a device for centering tubes arranged at a station of a textile machine and, more particularly, to such a centering device at a textile machine station for preparing spinning cops or tubes for a subsequent treatment operation and wherein the cops or tubes are conveyed to the station in a vertical position and the centering means is adapted to be brought into contact with the cop or tube from a standby position.

BACKGROUND OF THE INVENTION

It is possible for disruptions to occur at the winding stations of cheese-producing textile machines during the process of rewinding spinning cops into cheeses of large volume, which disruptions prevent the orderly complete unwinding of the spinning cops. Cop tubes with insufficient yarn remaining to be worth unwinding must be completely cleaned, i.e., the remaining yarn must be removed, before they can be returned to the spinning/winding process.

This cleaning process is carried out by applying a tool to the tubes and displacing the tool parallel with the tubes. It is necessary accordingly to exactly center the tubes, which typically are standing on transport plates, because otherwise there would be the danger that the tubes would be damaged.

A device is known, for example, from German Patent Publication DE 41 31 667 A1, wherein the remaining yarn is loosened by a stripper displacable along the tube and is subsequently suctioned off. In the process the spinning cops stand upright on the arbors of disk-shaped support bodies, which are conveyed over conveyor belts into the area of the cleaning device of the winding machine and are also conveyed away again over appropriate transport tracks.

The tube is centered during the removal of the remaining yarn from the tube so that the cleaning tool can operate optimally by being exactly placed relative to the tube, and the tube is not lifted off the support body in the course of stripping off the remaining yarn.

In this case a centering arbor used for this centering function must be matched in its length and diameter to the respective type of tubes. The material of the tubes must also be considered, since with sensitive tubes there is the danger that the arbor could widen the tube tip.

The cleaning device known from DE 41 31 667 A1 has a centering device which is adjusted or exchanged according to each respective batch, i.e., matched to a defined tube length and to a defined tube diameter. If a fresh batch is to be wound and the length of the tubes changes in the process, the centering device must be readjusted manually. If the diameter and/or the material of the tubes is changed, the centering means must be replaced. With plastic tubes the centering means customarily is a centering arbor which tapers in a conical shape toward a tip end of the arbor, while sensitive cardboard tubes are acted on by exterior centering means, which taper conically toward the top and are pushed over the tube.

It is furthermore disadvantageous in connection with this known device that in cases in which the winding machine is occupied by several batches having two or more different tubes circulating at the same time in the machine, these tubes cannot be processed in a common cleaning station if they differ in their length, their diameter and/or their material.

Cheese-producing textile machines can also have other processing stations besides the described tube cleaning devices, where centering of the tube during the processing steps is necessary.

Centering of the tubes is also advantageous during processing in cop preparation stations, where the reserve winding of ring spinning cops is released and the yarn end is placed in readiness for the subsequent rewinding process.

OBJECT AND SUMMARY OF THE INVENTION

It is accordingly an object of the present invention to improve the aforedescribed known devices for centering cops or tubes during their processing by appropriate tools.

This object is attained in accordance with the present invention by providing a device capable of selectively centering tubes having at least two differing physical characteristics when the tubes are delivered in sequence to a centering position of a work station of a textile machine in an upstanding disposition. Briefly summarized, the device comprises a holder, at least two different centering means mounted on the holder and respectively adapted for mated centering engagement with the differing tubes, and drive means for manipulating the holder relative to the centering position for orienting a selected one of the centering means for centering engagement with a corresponding one of the tubes thereat.

The device in accordance with the present invention has the particular advantage that tubes from different batches, which can differ from each other in respect to length, diameter and material, can be securely fixed in place without manual intervention in a mixed sequence. In this case the holder makes it possible to position at least two different centering means. The matching centering means for the tubes is selected in accordance with the previously determined length, tube diameter and/or tube material, and is placed into the centering position.

This process preferably runs automatically by utilizing sensor means which determine in advance the length, possibly the diameter and the material of the tubes. For releasing and centering the tubes, the holder supporting the centering means only needs to be displaced between two predetermined positions, the release position and the centering position of the tubes. For positioning the appropriate centering means, the holder is rotated in a vertical plane or laterally displaced. In this case it is advantageous to use a stepper motor for positioning the centering means, since such stepper motors make exact positioning possible in a simple way. However, a sensor-controlled positioning of the centering means is also conceivable.

Furthermore, an arrangement of the centering means on a holder which is rotatable in a horizontal plane is also possible. In this case, the centering means is arranged perpendicularly in respect to the plane of rotation of the holder.

The length and the diameter of the tubes can be determined by mechanical tracer elements or optical sensors. In an advantageous embodiment of the invention, the tubes or their support bodies can be provided with a marking or other data carrier, which provides information regarding the length, the diameter and/or the material of the respective tubes. For example, the support bodies or the tubes can each respectively have an electronic information carrier, in which the respective data are stored. The data are then read in a contactless manner during transporting of the tubes to a cleaning device equipped with the centering device in accordance with the invention, preferably via a reading device at a waiting position arranged upstream of the centering device, and the data are processed by a control device, which then selects the appropriate centering means.

If the centering device in accordance with the invention is a part of a tube cleaning device, it is possible in the course of the selection of the centering means to also preset the treatment path of the cleaning tool along the tube, because this treatment path must be matched to the length of the tubes. In this case, presetting of the treatment path can take place by means of presetting the number of steps of a stepper motor. Such a stepper motor has been shown to be an advantageous drive for the cleaning tools.

The invention will be explained in more detail below by means of exemplary embodiments described with reference to the accompanying drawings.

DETAILED DESCRIPTION OF THE PREFERRED EMBODIMENTS

Figure 1:
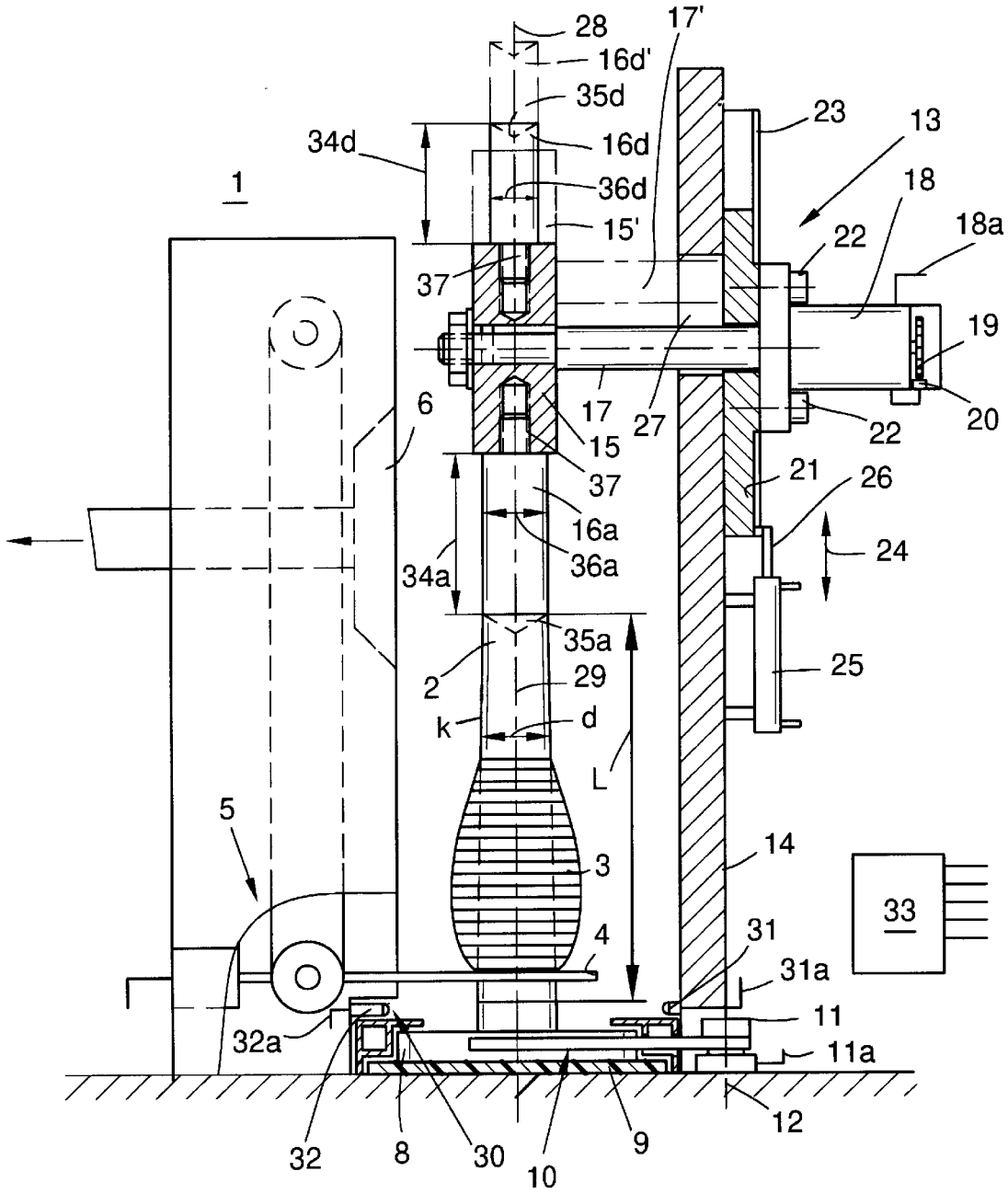
FIG. 1 is a side elevational view of a cleaning device with the centering device in accordance with the present invention.

An exemplary embodiment of the present invention is shown in FIG. 1 basically comprising a centering device 13 arranged in a schematically represented cleaning device 1, in which a tube 2 having remaining yarn 3 to be cleaned stands in a cleaning position. The cleaning tools, in the instant case stripping members 4 surrounding the tube 2, their drive 5 and the suction device 6 for removing the stripped remaining yarn are only schematically represented. The exact structure and function of such cleaning devices are known and have been explained relatively extensively in German Patent Publication DE 41 31 667 A1.

The tubes 2 to be cleaned, in this case a tube made of a plastic material k, are conducted on a conveyor belt 9 from a winding machine (not shown in detail) to the cleaning device while supported upright on an arbor of a disk-shaped support body 8. Once a tube containing remaining yarn to be removed reaches the cleaning position, the support body 8 is stopped, in the instant case, for example, by a rod-shaped blocker 10 which can be pivoted into the transport track by a motor 11 around a vertical shaft 12. However, any other device for positioning the tubes is also possible.

In addition, the cleaning device 1 has a centering device 13 disposed above the tube 2. The centering device 13 is comprised of a post element 14, on which a holder 15 supporting the centering means 16*a* to 16*f* (see also FIG. 2), is mounted to be movably, rotatably and vertically displaceable. A centering arbor 16*a*, which centers a plastic tube 2 with its cone-shaped tip 35*a*, and an upward pointing centering element 16*d* for sensitive tubes, is represented in FIG. 1. In this case the centering element 16*d* has a conically shaped recess 35*d* intended for the exterior centering of cardboard tubes.

The holder 15 is fastened on a horizontally arranged shaft 17 and is driven by a stepper motor 18. This stepper motor 18 furthermore has a positioning device. In this case the positioning device consists of a magnet wheel 19 having magnets arranged in the radial direction, and a Hall sensor 20. The positioning device is connected to a control device 33.

As indicated by screws 22, the motor 18 is fastened on a carriage 21, which is seated for vertical displaceability in a guide 23 of the post element 14. Displacement of the carriage 21 in the opposing directions indicated by the two-headed arrow 24 is performed by means of a pneumatic cylinder 25 fastened on the post element 14 and having an extending piston rod 26 connected to the carriage 21. The shaft 17, on which the holder 15 for the centering means 16*a* to 16*f* is rotatably seated, extends through a slit 27 in the post element 14.

It is also conceivable in place of the above described arrangement to provide an alternative embodiment utilizing a horizontally arranged support operative in the manner of a carrousel to be rotatable around a vertical shaft with the centering means extend vertically downward from the carrousel.

Figure 2:
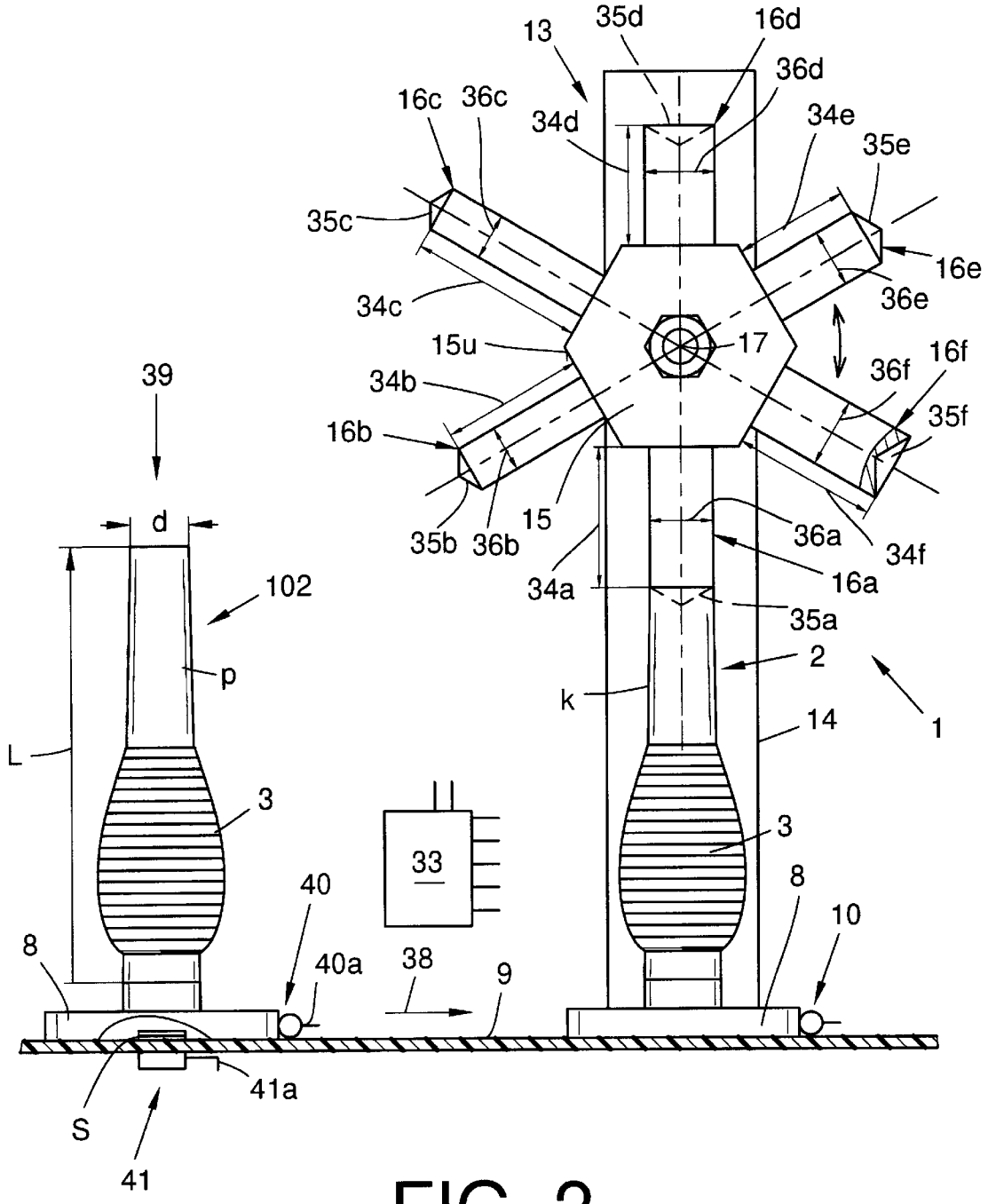
FIG. 2 is a front elevational view of the centering device in accordance with FIG. 1 with a further tube disposed in an upstream-located waiting position.

If a tube, such as the tubes 2 or 102 shown in FIG. 2, is intended to be moved into the cleaning position underneath the centering device 13, the holder 15 with its centering means 16*a*, 16*d* is initially raised into its lifted release position 15' as indicated in broken lines in FIG. 1.

Then the tube to be processed next is transported from a waiting position 39 upstream of the cleaning position 1 into the cleaning position 1 and stopped by the blocker 10 actuated via the line 11*a* by the control device 33 (see FIG. 2). In such case, the entry into the centering position is monitored by means of a photoelectric barrier 30 comprising a transmitter 31 and receiver 32 (FIG. 1). The correct positioning of the tube 2 is reported to the control device 33 via a signal line 32*a* from the transmitter 32. Thereupon, the pneumatic cylinder 25 is actuated to retract the piston rod 26 and displaces the carriage 21 with the holder 15 disposed thereon downwardly into the centering position represented in FIGS. 1 and 2. In the process, the downwardly projecting tip 35*a* of the centering means, formed in the instant case at the end of a centering arbor 16*a* which has been matched to the tube diameter d, the tube length L and the tube material plastic k, is lowered onto the upper tube end.

Once the tube 2 has been centered, the drive of the cleaning tools, in the form of the stripping members 4 in the depicted embodiment, is actuated by the control device 33 via the signal line 5*a*, and the remaining yarn 3 is stripped off the tube 2 upwardly in the direction toward the centering arbor 16*a*. In this case the maximum displacement path of the stripping members is preferably dependent on the selected centering means and can already be preset in the drive of the stripping members when selecting the centering means. If, for example, the displacement of the stripping members is performed by means of a stepper motor, the path to be traveled can be set by the preselection of a number of steps corresponding to a path length.

Following cleaning of the yarn from the tube, the carriage 21 is lifted by the cylinder 25 and in the process the centering means is lifted off the tube positioned in the cleaning position. Thus the cleaned tube is released and can be conveyed off. To this end the blocker 10, whose motor 11 is actuated via the signal line 11*a*, is retracted. The remaining yarn now on the centering arbor 16*a* is retained by a stripper (not shown), when the centering means is retracted into its release position 15', and removed by the suction device 6.

Thereafter the centering device 13 is again prepared for the next following tube, which can be different in length, diameter and/or material from the previous tube. In the process, the motor 18 is actuated by the control device 33 via the line 18*a* and the holder 15 is turned into a position in which the centering means matching the following tube is ready.

As previously indicated, FIG. 2 shows a front view of the centering device 13, depicting the waiting position 39 upstream of the cleaning device I (of which only the centering device 13 is represented ), as viewed in the transport direction 38. A tube 102 needing to be cleaned has been conveyed to the waiting position, whereat the tube 102 can be positioned by a blocker 40 actuated via the signal line 40*a* such that its identification, fixed on an information carrier in the support body 8, can be read. This identification provides information or data regarding the length L, the diameter d and/or the material p of the tube. In the instant exemplary embodiment, a reading station 41 is provided for this purpose adjacent the waiting position, in which the information can be read from a chip S in the support body 8 of the tube 102, for example. The information regarding the length and the diameter of the tube 102 are fed to the control device 33 via the line 41*a*, which then actuates the stepper motor 18 during the tube change in such a way that the matching centering means, in this case the centering means 16*d*, is turned into the downwardly oriented centering position.

In the instant exemplary embodiment the holder 15 has six different centering means 16*a* to 16*f*, which are replaceably arranged by means of screw connections 37 (FIG. 1) and are equidistantly distributed about the circumference 15*u* of the holder 15. The centering means 16*a* to 16*f* extend radially in respect to the rotating shaft 17 of the holder 15. The lengths 34*a* to 34*f* and the diameters 36*a* to 36*f* of the centering means are matched to the different batches of cop tubes to be processed. In the instant exemplary embodiment, for example, the centering means 16*d* and 16*e* are of equal length 34*d* or 34*e*, but are intended for tubes made from different materials. The centering means 16*d*, designed for cardboard tubes, has a conically shaped recess 35*d*. The centering arbors 16*b* and 16*c* are intended for tubes of different length but of the same diameter, as can be seen from the corresponding diameters 36*b* or 36*c*. The centering arbor 16*f* has a conically shaped cutout 35*f* and is therefore used for centering cardboard tubes.

Figure 3A:
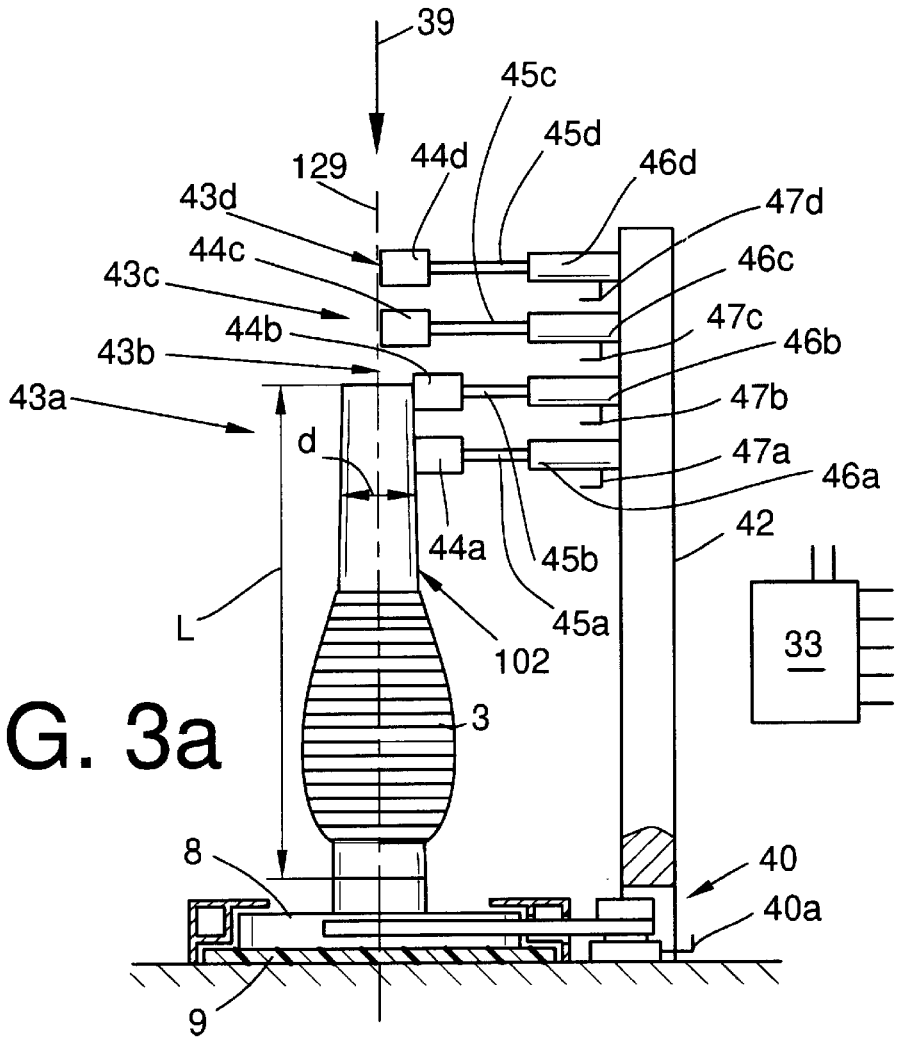
FIG. 3*a* is another side elevational view similar to FIG. 1 showing a mechanically actuated sensor device for determining the length and the diameter of a tube.
Figure 3B:
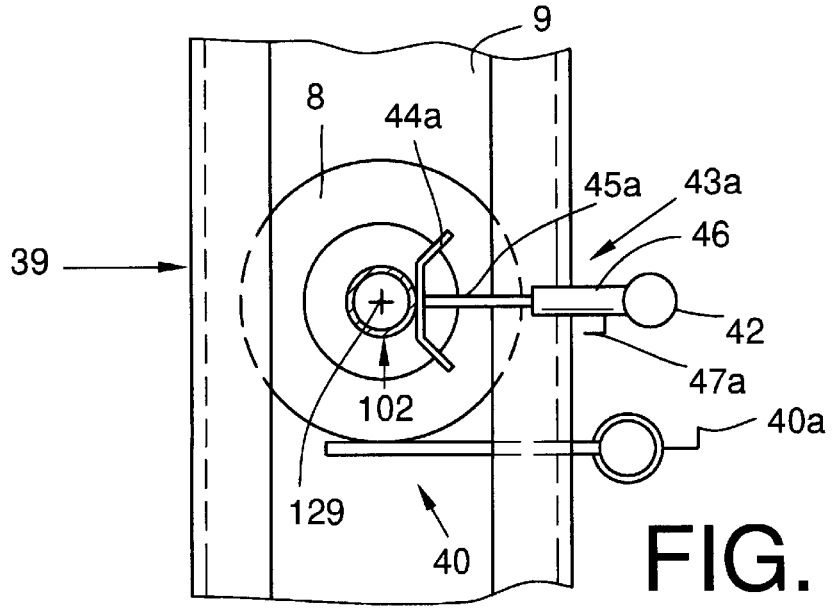
FIG. 3*b* is a top plan view of the sensor device in accordance with FIG. 3*a*.

A device for mechanical tracing of the tube length and the tube diameter is represented in FIGS. 3*a* and 3*b*. A holder 42, which in this exemplary embodiment has four mechanical tracers 43*a*, 43*b*, 43*c* and 43*d*, is placed next to the conveyor belt 9 in the waiting position 39. These tracers are arranged on the holder 42 in such a way that they can trace, i.e., detect, four tubes of different length. The length of the tube is determined by means of the number of actuated tracers, and the appropriate corresponding centering element is selected as a function thereof. The tracers consist of angled sheet metal strips 44*a* to 44*d*, which are fastened on respective guide rods 45*a* to 45*d* extendable as far as the axis 129 of the tube 102. While being conveyed, the tube 102 pushes a number of tracers corresponding to its length out of their base position, namely the tracers 43*a* and 43*b* in the case of the tube 102 illustrated in FIG. 3. The guide rods 45*a* to 45*d*, on which the sheet metal strips are fastened, are thereby retracted into cylinders 46*a* to 46*d* against the outward biasing force of weak springs. In the course of pushing these guide rods into the cylinders, moving coils or sliding resistors, for example (not shown in FIG. 3*a*), are actuated. The corresponding signals are transmitted via the signal lines 47*a* to 47*d* to the control device 33.

Figure 4:
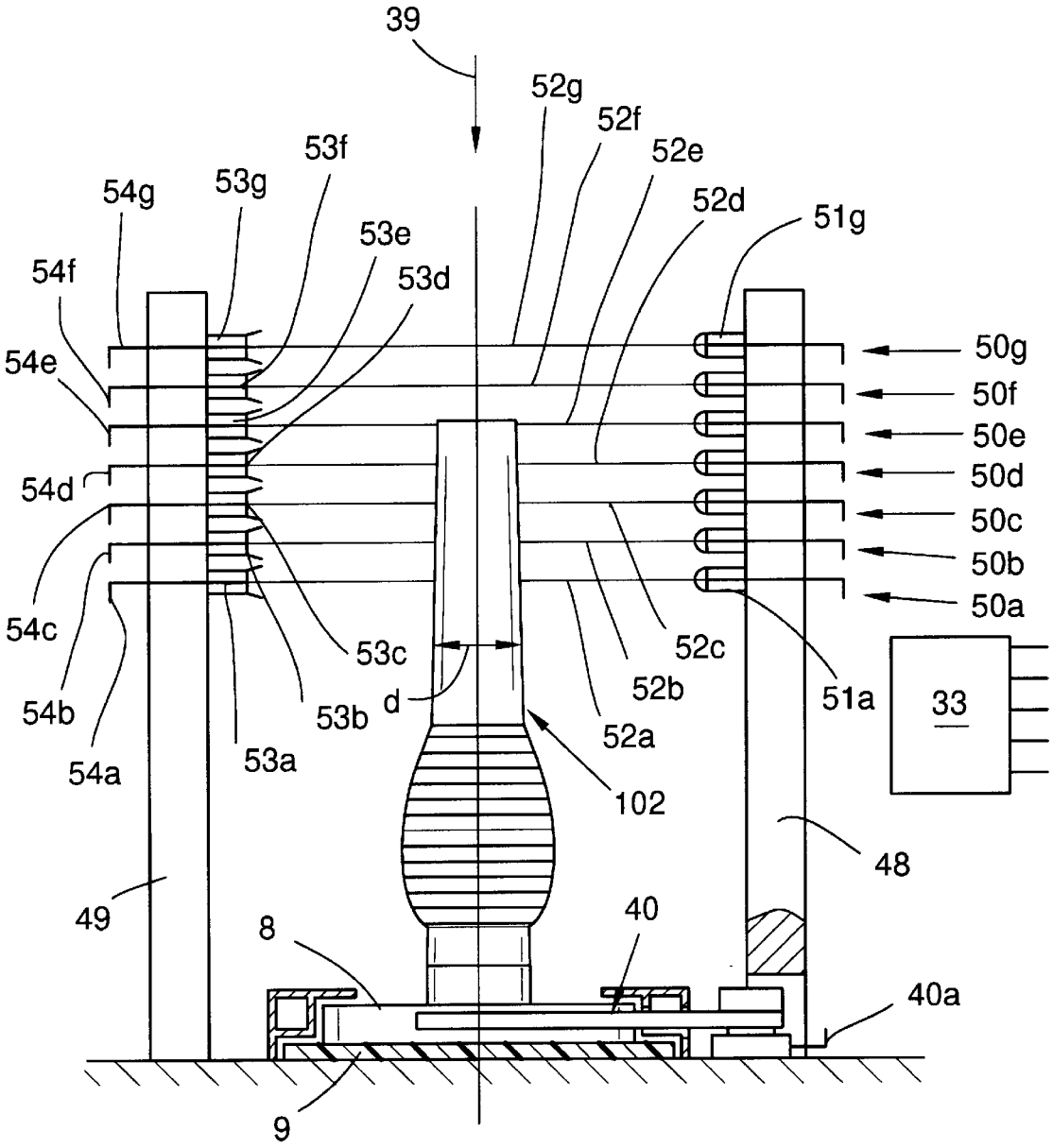
FIG. 4 is another side elevational view similar to FIGS. 1 and 3 showing an optical sensor device for determining the length and diameter of a tube.

A further exemplary embodiment of a sensor device for determining the tube length L is represented in FIG. 4. Seven light emitters and light receivers arranged one above the other respectively on two opposed facing holders 48 and 49 located at opposite sides of the conveyor 9 establish seven respective photoelectrical barriers 50*a* to 50*g* at differing elevations above the conveyor. Depending on the length of a tube, a different number of the light rays 52*a* to 52*g* emitted by the light emitters 51*a* to 51*g* are interrupted. In the instant exemplary situation, the tube 102 interrupts the light rays 52*a*–52*e* so that only the light receivers 53*f* and 53*g* receive the corresponding light beam 51*f* and 51*g*. Based on the signals reported to the control device via the signal lines 54*a* to 54*g*, a centering means matched to the tube 102 can be selected.

Only the length L of the tubes can be determined by means of the photoelectric barriers of this exemplary embodiment. The diameter could be determined by horizontally extending sensors of the photoelectric barriers, whereby the amount of shielding of the shielded sensors would be a measure for the respective tube diameter.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A device for selectively centering tubes having at least two differing physical characteristics when the tubes are delivered in sequence to a centering position of a work station of a textile machine in an upstanding disposition, the device comprising a holder, at least two different centering means mounted on the holder and respectively adapted for mated centering engagement with the differing tubes, and drive means for manipulating the holder relative to the centering position for orienting a selected one of the centering means for centering engagement with a corresponding one of the tubes thereat.

2. The device in accordance with claim 1, wherein the centering means respectively have different lengths.

3. The device in accordance with claim 1, wherein the centering means respectively comprise centering arbor of different diameters.

4. The device in accordance with claim 1, wherein the centering means are matched structurally to the material of the tubes.

5. The device in accordance with claim 4, wherein at least one of the centering means is configured for external engagement with a respective one of the tubes.

6. The device in accordance with claim 1, wherein the holder is rotatable with respect to a supporting shaft and the centering means extend radially in respect to the shaft at circumferential spacings thereabout.

7. The device in accordance with claim 1, and further comprising sensor means for detecting at least one of a length characteristic, a diameter characteristic and a material characteristic of the tubes to be centered, and a control device connected with the sensor means for actuating the drive for selecting a respective centering means.

8. The device in accordance with claim 7, wherein the sensor means comprise mechanical elements for engaging the tubes for determining the length and the diameter thereof.

9. The device in accordance with claim 7, wherein the sensor means comprise sensors for optically determining the length and the diameter of the tubes.

10. The device in accordance with claim 7, wherein the sensor means is arranged at a waiting position located upstream of the centering position.

11. The device in accordance with claim 1, and further comprising an information carrier associated with each tube containing detectible data representing the length, the diameter and the material of the tube.

12. The device in accordance with claim 11, and further comprising a reading station in advance of the centering station for reading the information carrier of each tube.

13. The device in accordance with claim 1, wherein the drive means comprises a stepper motor for driving the holder positioning the centering means.

14. The device in accordance with claim 1, and further comprising means at the centering position for cleaning the tubes of remaining yarn.

* * * * *